United States Patent [19]

Furbee et al.

[11] Patent Number: 4,685,118

[45] Date of Patent: Aug. 4, 1987

[54] X-RAY TUBE ELECTRON BEAM SWITCHING AND BIASING METHOD AND APPARATUS

[75] Inventors: Avery D. Furbee, Elmhurst; Viktor W. Pleil, Wheaton; James E. Burke, Villa Park, all of Ill.

[73] Assignee: Picker International, Inc., Cleveland, Ohio

[21] Appl. No.: 752,311

[22] Filed: Jul. 3, 1985

Related U.S. Application Data

[63] Continuation-in-part of Ser. No. 550,755, Nov. 10, 1983, abandoned.

[51] Int. Cl.[4] ..... H05G 1/56; H01J 35/14

[52] U.S. Cl. ..... 378/114; 378/115; 378/138

[58] Field of Search ..... 378/113, 92, 114, 115, 378/136, 137, 138, 207; 313/302, 304, 409, 414

[56] References Cited

U.S. PATENT DOCUMENTS

| | | | |
|---|---|---|---|
| 1,923,876 | 8/1933 | Mutscheller . | |
| 1,946,286 | 2/1934 | Kearsley . | |
| 3,110,810 | 11/1963 | Fransen . | |
| 3,646,379 | 2/1972 | Garewal et al. . | |
| 3,649,861 | 3/1972 | Atlee et al. | 378/138 |
| 3,683,191 | 8/1972 | Maclachan et al. | 378/98 |
| 3,743,836 | 7/1973 | Holland et al. . | |
| 3,783,287 | 1/1974 | Fulton et al. | 378/138 |
| 3,783,333 | 1/1974 | Atlee et al. | 378/138 |
| 3,857,039 | 12/1974 | Franke et al. | 378/115 |
| 3,859,534 | 1/1975 | Loughlin | 378/125 |
| 3,946,261 | 3/1976 | Holland et al. . | |
| 3,992,633 | 11/1976 | Braun . | |
| 3,999,074 | 12/1976 | Callaghan . | |
| 4,032,843 | 6/1977 | Loucks . | |
| 4,065,689 | 12/1977 | Pleil | 378/138 |
| 4,213,048 | 7/1980 | Quang et al. . | |
| 4,266,133 | 5/1981 | Weigl et al. . | |
| 4,361,901 | 11/1982 | Daniels et al. | 378/113 |
| 4,373,144 | 2/1983 | Franke . | |
| 4,578,767 | 3/1986 | Shapiro | 378/207 |

*Primary Examiner*—Janice A. Howell

*Attorney, Agent, or Firm*—Watts, Hoffmann, Fisher & Heinke Co.

[57] ABSTRACT

An X-ray tube having a capability to produce multiple anode spots. The X-ray tube can produce three or more different size anode focal spots without modification of the connectors, cabling, or high voltage supply for routing high voltage signals to the X-ray tube. An isolating fiber optic control input connects an external light emitting diode to a controller inside the tube housing. The controller responds to light signals from the light emitting diode to control the size of focus spots on the tube anode. In a preferred embodiment each of three filaments are individually energized to produce three different size focal spots and a cathode cup to which the filaments are mounted is also biased to add a four spot capability. In an alternate embodiment a split or segmented cathode cup has its segments biased to different electrical potentials by tapping power from a conventional high voltage filament supply used in energizing a cathode filament. Confirmation circuitry monitors operation of the controller and deactivates the X-ray tube in the event of a controller malfunction.

28 Claims, 21 Drawing Figures

REFERENCE INDICATOR CIRCUIT SUPPLIED BY USER

X-RAY TUBE ELECTRON BEAM SWITCHING AND BIASING METHOD AND APPARATUS

REFERENCE TO RELATED APPLICATION

This is a continuation-in-part of application Ser. No. 550,755 filed Nov. 10, 1983 under the title "X-ray Tube Electron Beam Switching and Biasing Method and Apparatus", now abandoned.

TECHNICAL FIELD

The present invention concerns a multiple focus X-ray tube for generating multiple focal spots on a single rotating anode surface.

BACKGROUND ART

Conventional diagnostic use of x-radiation takes the form of either radiography where a shadow image of a patient is produced on a photographic film or fluoroscopy where a visible shadow light image is produced by X-rays impinging on a fluorescent screen.

In a typical X-ray tube, electrons are accelerated as a beam from a tube cathode through an evacuated chamber to a tube anode. When the electrons strike the anode with large kinetic energies they experience a sudden deceleration and x-radiation is produced. The X-ray tube includes a window, transmissive to X-rays, spaced from the anode at an appropriate position so that radiation from the anode passes through the window toward a subject undergoing examination or treatment.

Many tube designs use filaments as a source of electrons to bombard the tube anode. A filament is a coil of wire which is eIeotrically energized so that electrons are thermionically emitted and accelerated toward the anode due to a voltage difference between cathode and anode.

The cathode filament is thermionically energized with a relatively low voltage (on the order 10 volts) and high current A.C. signal. Although the peak-to-peak magnitude of the energization signal is low the reference or average potential of the filament is about −75,000 volts D.C. Stated another way, the voltage on the filament with respect to ground is up to −75,000 volts plus or minus a low level alternating current signal needed to boil off electrons from the filament. At these high voltages, filament inputs must be insulated to prevent arcing. The insulation typically is in the form of high voltage cabling and connectors which are expensive and complex in design.

A trend towards shorter exposure times in radiography has dictated a need for greater intensity of radiation and hence higher electron currents. Attempts to increase the intensity while decreasing the focal spot size can cause overheating of the X-ray tube anode. For this reason, various cooling techniques are known and are incorporated into present day X-ray tubes. Primarily among these techniques are use of rotating anodes which limit heat build up on any one anode spot and oil immersion of the entire tube in a circulating bath which dissipates heat build up. U.S. Pat. Nos. 4,097,759 and 4,097,760 which issued on June 27, 1978 and are assigned to the Picker Corporation. These patents concern the problems of heat dissipation in an X-ray tube anode and are incorporated herein by reference.

As the art of radiography and fluoroscopy has matured, a need for multiple size focal spots has developed so that one X-ray tube can be used for different diagnostic procedures. By way of example, it is desirable to be able to produce a one millimeter long spot for general purpose spot films, a 0.6 millimeter spot for a 105 millimeter camera, a 0.3 millimeter spot for arthrograms, and a 0.15 millimeter spot where magnification is required.

One way to change the size of the focal spot is to use multiple cathode filaments mounted on a single cathode support cup. A dual filament cathode for producing different size focus spots on one X-ray tube anode is shown and discussed in U.S. Pat. No. 4,109,151 to Pleil. Focal spot size can also be controlled to some degree by placing a bias voltage between cathode cup and filament.

Proposals to adjust the current flow with a bias potential in the vicinity of a filament or to increase the number of filaments beyond two have been difficult to accomplish. The reason for this difficulty is the insulating requirements for the high voltage inputs needed for biasing and/or filament energization.

U.S. Pat. No. 4,373,144, entitled "Cathode Arrangement for an X-ray Tube", which was issued Feb. 8, 1983, discusses a procedure for enhancing the flexibility of an X-ray tube in producing multiple size focal spots. The proposal in the '144 patent is to divide a cathode focusing cup into multiple segments which are insulated from each other and then controllably energize those segments, thereby changing the focusing effect the cathode cup has on the size and shape of the focal spot. This proposal may have merit but is apparently accomplished at the expense of added complexity in the routing of signals to the tube anode. There is no indication of how the proposal of the '144 patent is to be implemented. In addition, the '144 patent does not shield the insulating segments against metal deposits. Metal deposits from the filament can short circuit the cup segments resulting in failure to maintain proper voltage levels between segments.

DISCLOSURE OF THE INVENTION

The present invention relates to a multiple focus energization scheme for an X-ray tube requiring no additional high voltage inputs to the tube thereby avoiding any increase in the complexity of the high voltage routing to the X-ray tube. Practice of the invention allows conventional X-ray tube cabling and connectors to be utilized while increasing the multiple spot producing capability of the tube.

The disclosed tube apparatus includes an anode which defines a target for a beam of electrons so that collisions between the electrons and the anode generate x-radiation from an anode focal spot. A cathode for producing the flow of electrons includes one or more energizable filaments which thermionically emit electrons. The anode and cathode structures are enclosed in an evacuated envelope so that the electrons travel unimpeded to the anode focal spot or target.

The apparatus additionally includes focusing circuitry for adjusting the flow of electrons from the cathode thereby controlling the size and shape of the anode focal spot. This focusing circuitry is mounted inside the tube housing and coupled to high voltage inputs for selectively energizing the one or more filaments in the X-ray cathode. A controller outside the tube housing controls focusing action of the circuit by selectively activating a switch inside the X-ray tube housing.

In a preferred embodiment, the controller energizes a photodiode outside the tube housing to selectively energize a switching transistor inside the housing floating at about minus 75,000 D.C. A fiber optic light pipe transmits light from the photodiode to the switching transistor to turn the transistor on and off. The fiber optic cable isolates the transistor from ground and requires no additional high voltage electrical input to the tube housing.

In this preferred embodiment of the invention, the cathode has multiple, individually energizable cathode filaments. The focusing circuitry includes means for selectively applying a filament energization signal across one of the filaments to produce a desired focal spot size and shape on the anode. The disclosed version of this preferred embodiment has three filaments, but the principles used can be extended to energize other numbers of filaments. The geometrical design of a preferred cathode focusing cup causes the focal spots to be superimposed on the anode. This three filament embodiment can also include circuitry for controlling a bias on a cathode focusing cup to which the filaments are mounted. This feature enables four distinct size focal spots to be created from a three filament tube.

The preferred focusing circuitry also monitors filament switching. If a malfunction is sensed, the x-ray tube is deactivated so that the problem can be investigated. This avoids a situation where one size focal spot is called for but due to a malfunction a different size focal spot is produced.

In a second embodiment of the invention the cathode has a segmented focusing cup divided into three conductive segments separated by insulating material. In this embodiment the circuitry controllably biases or energizes the segments. In one state of energization, two outer segments are energized to the same potential and a third segment sandwiched between the two outer segments is energized to a different potential. This energization arrangement is to be contrasted with an alternate state where all three segments of the segmented focusing cup are at the same potential. The two energization states produce different electron energy and cross section from a given filament energization and thus different size spots on the anode.

In this embodiment the focusing circuit includes a transformer and full-wave rectifier coupled to a filament energization input. The transformer steps up the A.C. signal used to energize the filament and the rectifier then forms a D.C. signal to energize the outer segments of the focusing cup. By tapping off the filament voltage, no additional voltage source is needed for the cathode segments.

A preferred split segment cathode cup has three segments separated by insulating blocks or members brazed to the segments to hold them together while isolating them electronically. A surface of the cathode cup facing the anode is made up of the three conductive segments separated by slots or gaps extending into the body of the cup. These slots extend to the insulating blocks yet do not allow evaporated material from either the anode or filaments to reach those blocks. This feature preserves electrical isolation of the cup segments.

From the above it should be appreciated that one object of the present invention is a more flexible X-ray tube capable of producing multiple focal spots without the necessity for redesigning the high voltage inputs to such a tube. This and other advantages, objects, and features of the present invention will become better understood when a detailed description of the invention is discussed in conjunction with the accompanying drawings.

BEST MODE FOR CARRYING OUT THE INVENTION

Figure 1:
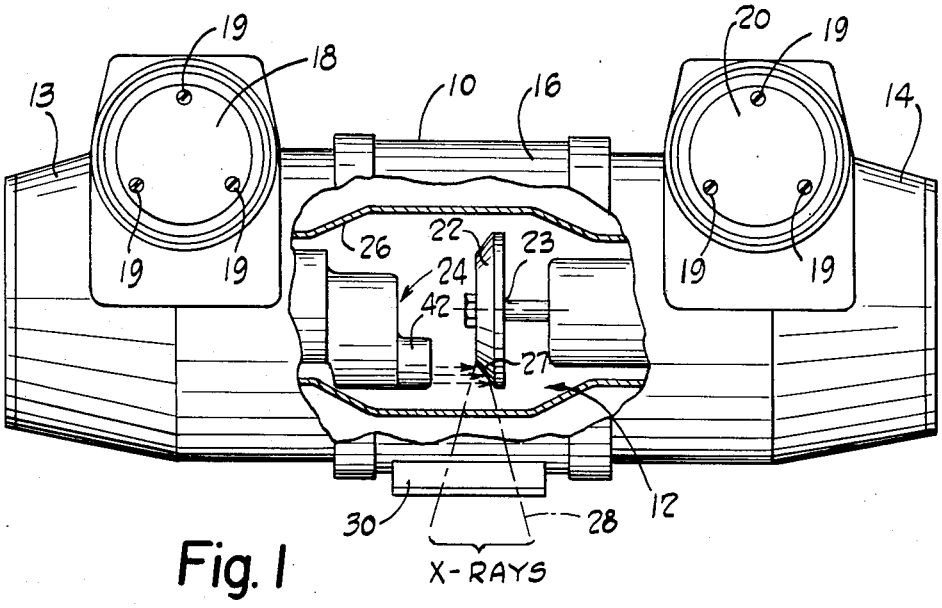
FIG. 1 is a schematic of an X-ray tube mounted in a tube housing.

Turning now to the drawings, FIG. 1 shows an X-ray tube housing 10 enclosing an X-ray tube 12. The tube housing 10 comprises two end portions 13, 14 and an intermediate or middle portion 16. The intermediate portion is coupled to the end portions by fluid tight seals to allow the X-ray tube housing 10 to be filled with an insulating fluid, typically oil. Connected to the end portions 12, 14 are two electrical cable connectors 18, 20 which transmit up to three high voltages inputs to the X-ray tube 12 through three pin contacts 19.

The X-ray tube 12 includes an anode 22 mounted for rotation about an axis 23 and a fixed cathode 24 mounted within an evacuated glass envelope 26. Electrons emitted by a cathode filament accelerate towards a target or focal spot 27 of the anode and cause X-rays 28 to be emitted. The anode 22 is rotated in a conventional manner to distribute the heating about the anode circumference.

The intermediate portion 16 of the X-ray tube housing 10 includes an X-ray transmissive window 30 of high impact plastic material such as "lexan". The window 30 is in alignment with the anode focal spot 27 from which the X-rays 28 are emitted so that the X-rays pass through the window to the exterior of the housing.

Further details regarding the construction and arrangement of an X-ray tube housing may be obtained by referring to either U.S. Pat. Nos. 3,859,534 to Laughlin or 4,097,759 to Furbee et al, both of which have been assigned to the Picker International, Inc. assignee of the present invention. Those patents are incorporated herein by reference.

Figure 14:
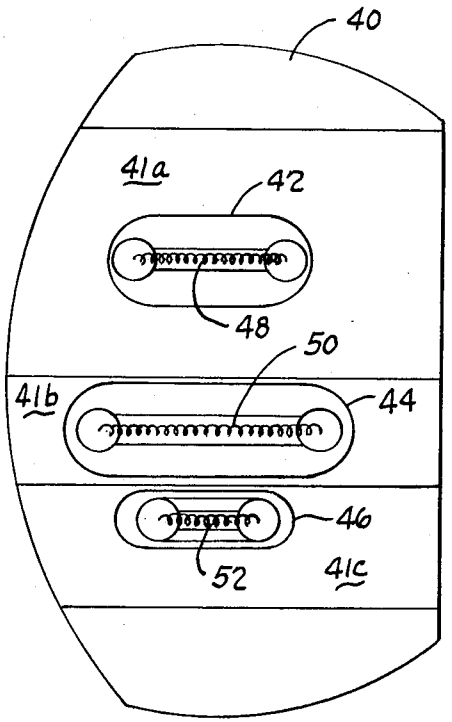
FIG. 14 is a front elevation view of a preferred cathode focusing cup.
Figure 15:
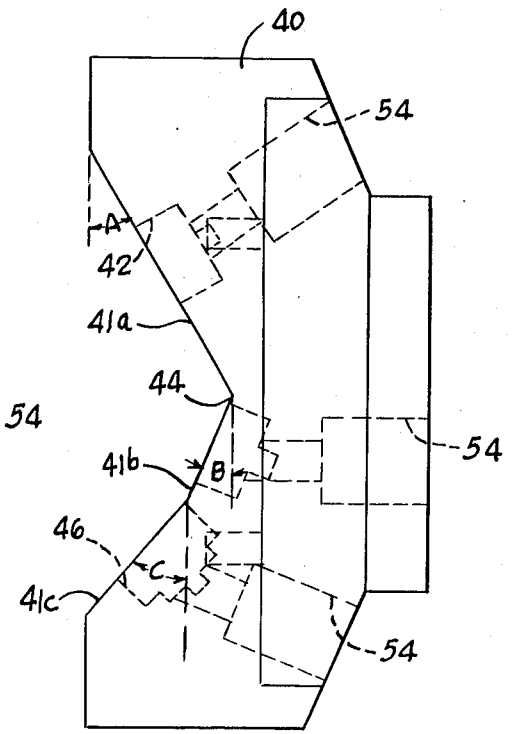
FIG. 15 is a side elevation view of the FIG. 14 cathode focusing cup.
Figure 16:
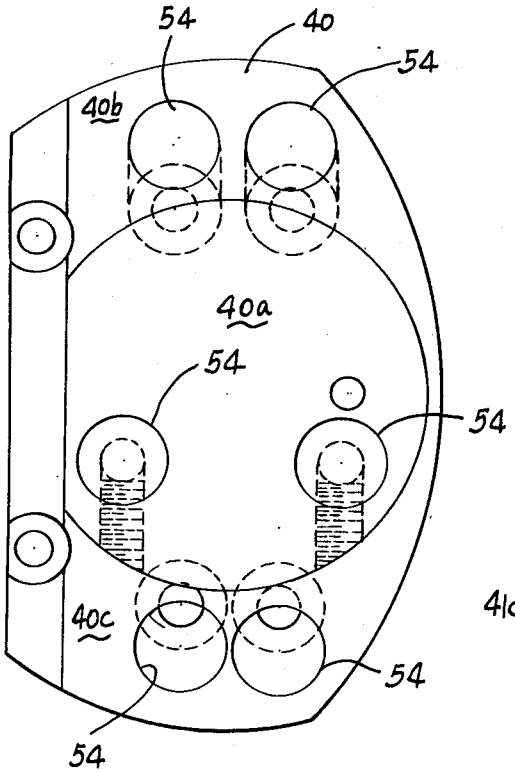
FIG. 16 is a rear elevation view of the FIG. 14 cathode focusing cup.

A preferred cathode cup 40 is illustrated in FIGS. 14–16. This cup 40 is made of nickel and defines three transverse cavities or slots 42, 44, 46. Two cavities 42, 44 are divided into two steps and a third cavity 46 is divided into three steps. An innermost step of each cavity supports an associated cathode filament. The FIG. 14 cathode cup thus supports three separately energizable filaments 48, 50, 52. Energization inputs to these filaments 48, 50, 52 are routed from rear surfaces 40*a*, 40*b*, 40*c* of the cathode cup 40 through apertures 54 extending from these surfaces to the respective filaments 48, 50, 52.

Figure 19:
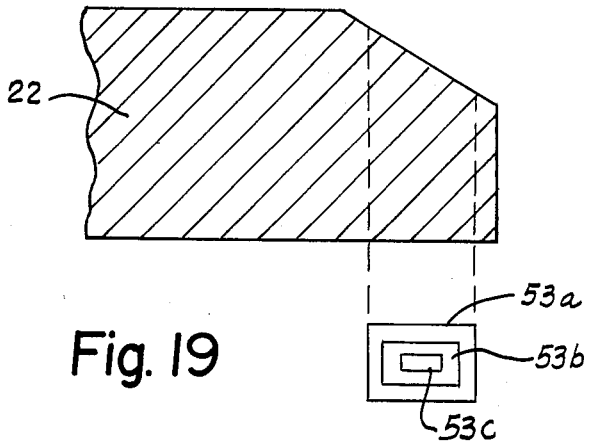
FIG. 19 is a sectional view of a rotating anode showing the location and relative position of focal spots for different filament energizations.

The three filaments 48, 50, 52 are of different length so that energization of each filament produces a distinct and unique size focal spot on the anode 22. The filaments are controllably actuated or energized to produce the three different size focus spots 53*a*, 53*b*, 53*c* shown in FIG. 19. This energization is accomplished with three voltage inputs 54L, 54C, 54S (FIG. 17) to the X-ray tube housing 10. These inputs come from isolation transformers located outside the tube housing 10, and may be referenced by as much as −75,000 volts D.C. with respect to the tube housing.

A cathode cup surface facing the anode 22 is divided into three distinct planar surfaces 41*b*, 41*c*, 41*d*. The angles A, B, C these surfaces made with a reference direction determine, in part, where electrons from the filaments strike the anode 22. In the cathode cup configuration of FIG. 15 electrons from the three filaments produce the superimposed focal spots 53*a*, 53*b*, 53*c*, of FIG. 19. Representative values of A, B, and C are 30°, 22°, and 40°. These angles may be adjusted to achieve a desired position of focal spots on the anode.

Figure 20:
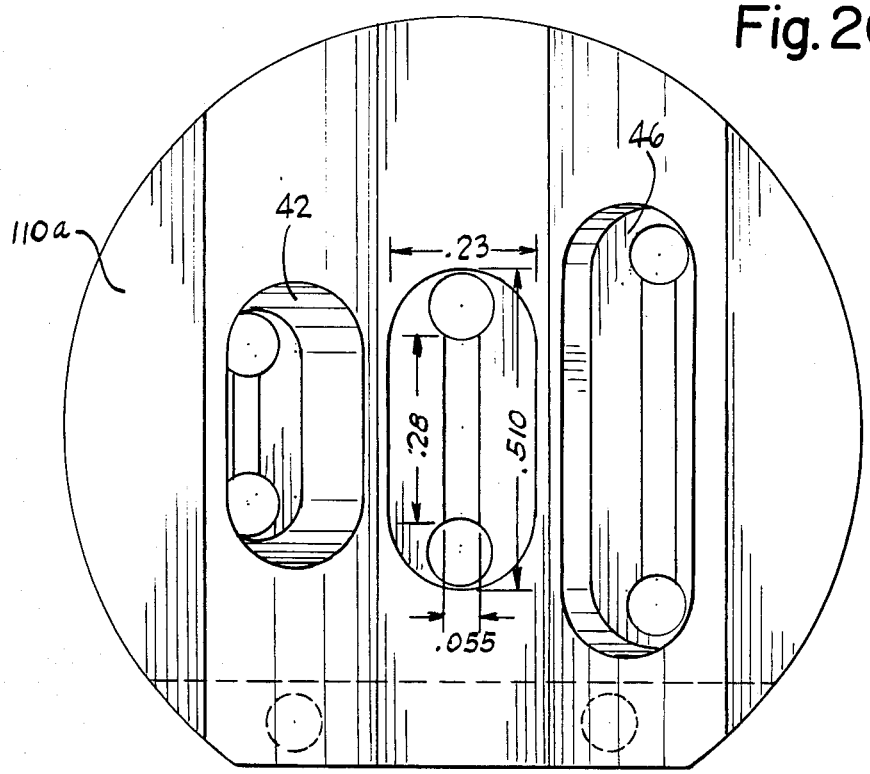
FIG. 20 is a front elevation view of an alternate cathode focusing cup.
Figure 21:
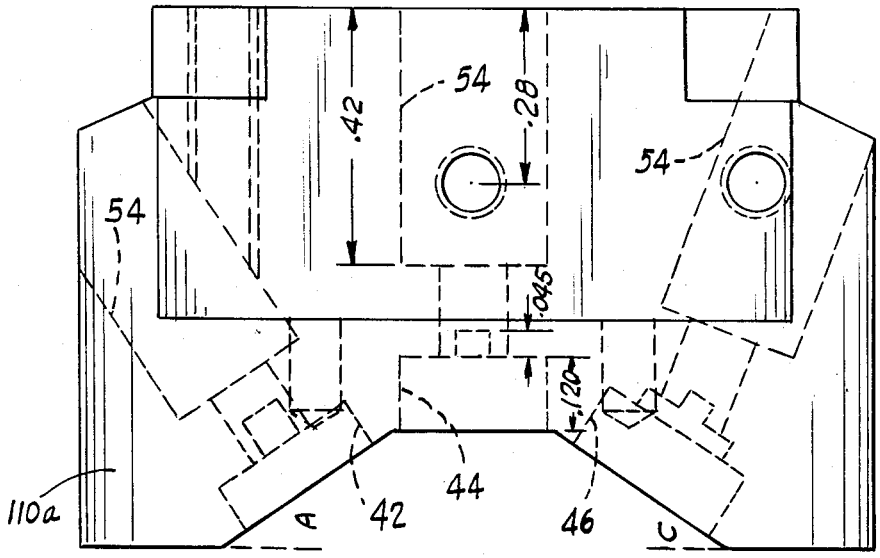
FIG. 21 is a side elevation view of the FIG. 20 cathode focusing cup.

An alternate cathode cup 110*a* of symmetrical configuration is illustrated in FIGS. 20–21. Its function is identical with that of cathode cup 110, however the face angles are changed such that A and C are identical, and angle B is 0°. A representative value of A is 34°, but may be adjusted to achieve a desired position of focal spots on the anode. This configuration has the advantage of a higher emission capability of the centerfilament 50. Representative dimensions in this alternate cathode cup are in inches.

Figure 17:
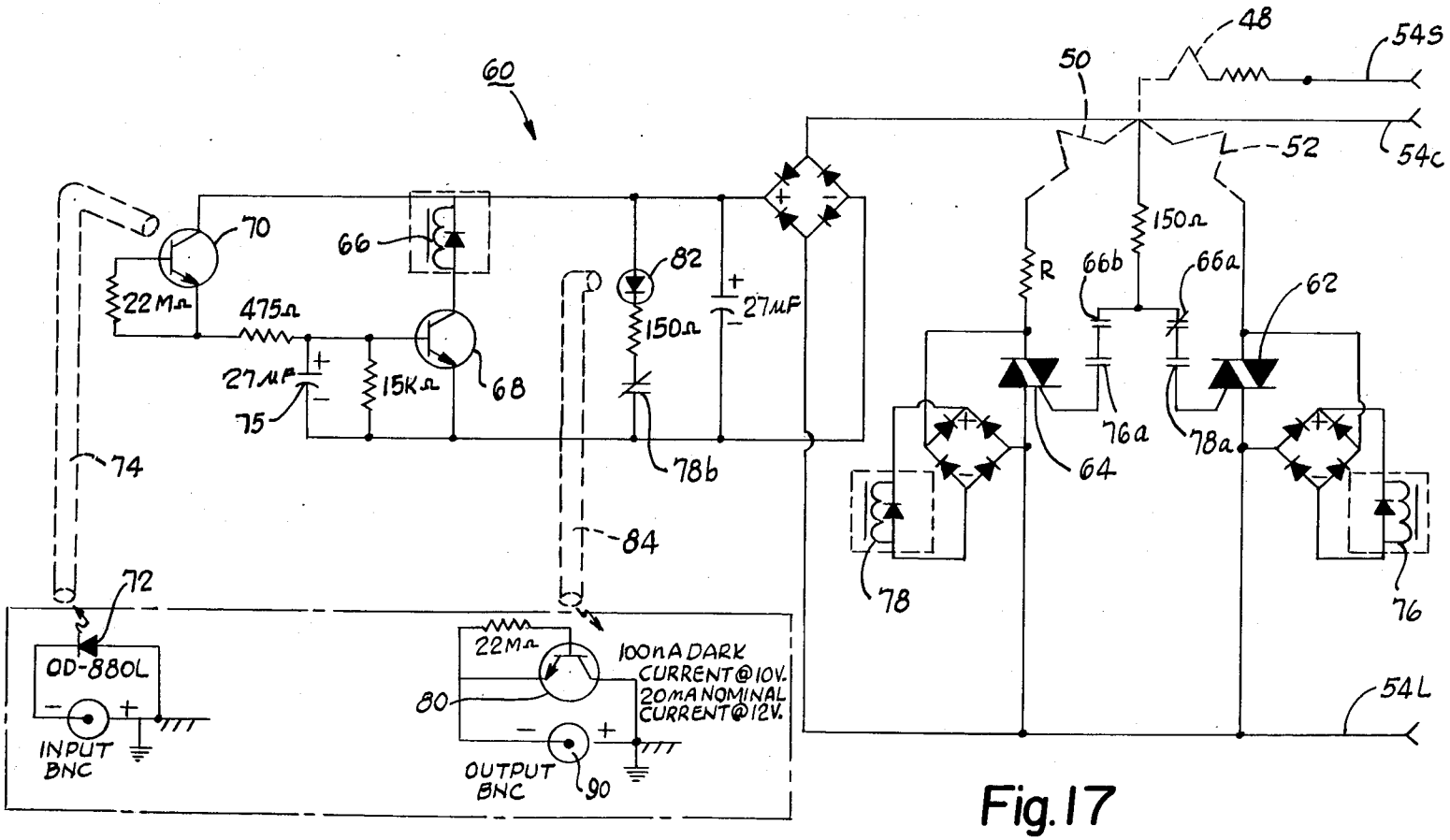
FIG. 17 is a schematic showing a preferred energization circuit for the filaments mounted to the cathode cup shown in FIGS. 14–16.

A circuit 60 for controlling energization of the three filaments 48, 50, 52 is illustrated in FIG. 17. Since the circuit 60 includes only three high voltage inputs 54S, 54C, 54L, the construction of the connector or coupling 18 need not be altered even though the cathode has three rather than the conventional two filaments. To energize the filament 48 the two inputs 54S and 54C are energized and the filament 48 thermionically emits electrons. The common input 54C carries a D.C. potential of up to about −75,000 volts D.C.

When the two inputs 54L and 54C are energized, one of the filaments 50, 52 is energized depending on which of two triacs 62, 64 is rendered conductive. Gate inputs to the two triacs are coupled to the input 54C through relay contacts that determine which triac conducts.

Two contacts 66*a*, 66*b* are opened and closed under control of a relay coil 66. The coil 66 conducts when a transistor 68 is biased into conduction by a photosensitive switching transistor 70 coupled to a photodiode 72 outside the housing 10 via a light pipe 74. A capacitor 75 across the base input to the transistor 68 slows response of the relay coil 66. This provides noise immunity to prevent random noise from triggering the transistor 68.

When the photosensitive transistor 70 is turned on by a signal from the photodiode 72 the coil 66 conducts and normally closed contact 66*a* opens. In this situation the triac 62 does not conduct and the voltage across this triac 62 rises.

The rise in voltage across the triac 62 energizes a relay coil 76 that closes normally open contact 76*a* at the gate of the triac 64. Both the contacts 66*b*, 76*a* are now closed and this triac now conducts to energize the filament 50.

With the diode 72 nonconducting the transistor 70 turns off and de-energizes the relay coil 66. Contact 66*b* opens and the triac 64 turns off. This causes the voltage across this triac 64 to rise and energize a relay coil 78 closing a contact 78*a* at the gate of the triac 62. The contact 66*a* is also closed so the triac 62 is gated on to energize the filament 52.

A photosensitive transistor 80 outside the housing 10 is used to confirm the filaments have been properly energized. The transistor 80 is turned on by a light signal from a photodiode 82 inside the housing 10 coupled to the transistor 80 by a light pipe 84.

A normally closed relay contact 78*b* controls the status of the photodiode 82. This contact 78*b* is opened when the coil 78 is energized so that no light is generated by the diode 82 when the filament 50 is off and the filament 52 energized. Conversely, with the filament 50 energized and the filament 52 off the diode 82 conducts and the transistor 80 turns on.

The reason for this additional circuitry is to prevent a circuit fault permitting the wrong filament to be excited. For example, if a signal input element such as the diode 72 should fail, when a user input calls for the filament 50 to be energized, filament 52 would acutally be turned on. There would be no output indication by the photodiode 82 which would indicate that the filament 50 was not excited and that an exposure should not be made because of a fault. Similarly if the filament 52 is called for and there is a signal from the photodiode, this would indicate a fault since the diode 82 should not be excited when the user calls for filament 52. The generator logic for the X-ray tube does not take exposures and the malfunction is investigated.

Figure 18:
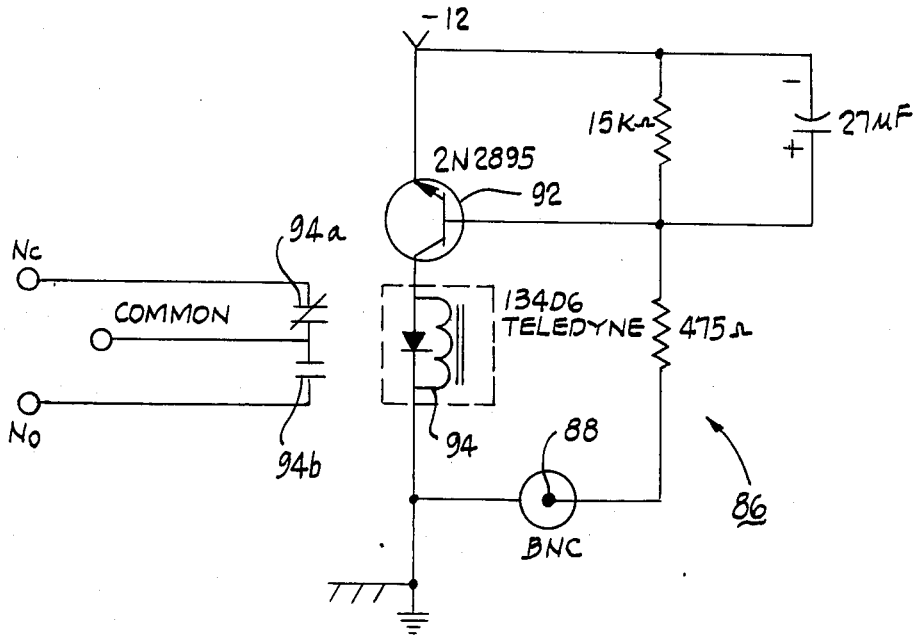
FIG. 18 is an indicator circuit for monitoring operation of the FIG. 17 circuit.

A generator logic circuit 86 for analyzing an output from the transistor 80 is depicted in FIG. 18. An input 88 coupled to an output 90 from the transistor 80 biases a transistor 92 that turns on and off a relay coil 94 having switch contacts 94*a*, 94*b*. These contacts are used to automatically de-activate the x-ray tube if a proper logic state is not indicated.

Figure 2:
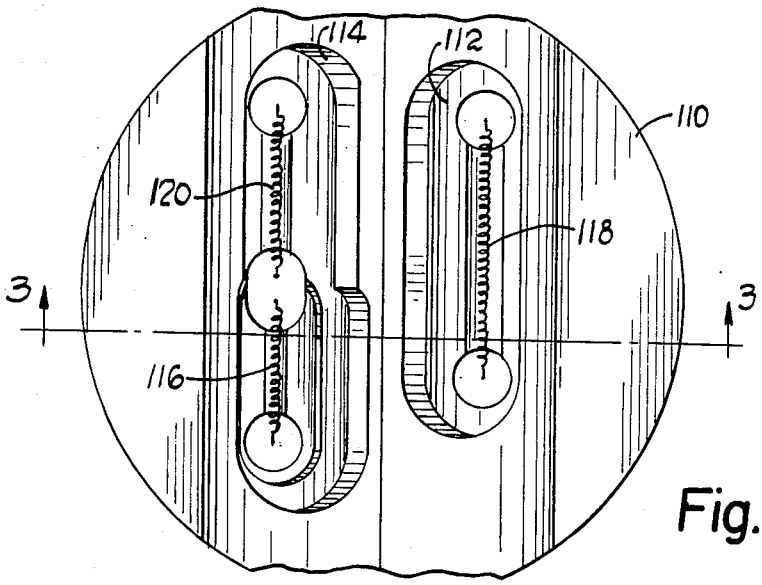
FIG. 2 is a front elevation view of a cathode focusing cup.
Figure 3:
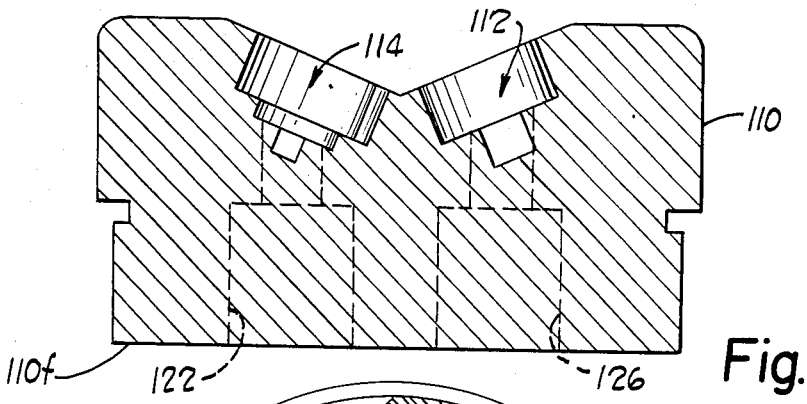
FIG. 3 is a sectional view taken along the line 3—3 in FIG. 2.
Figure 4:
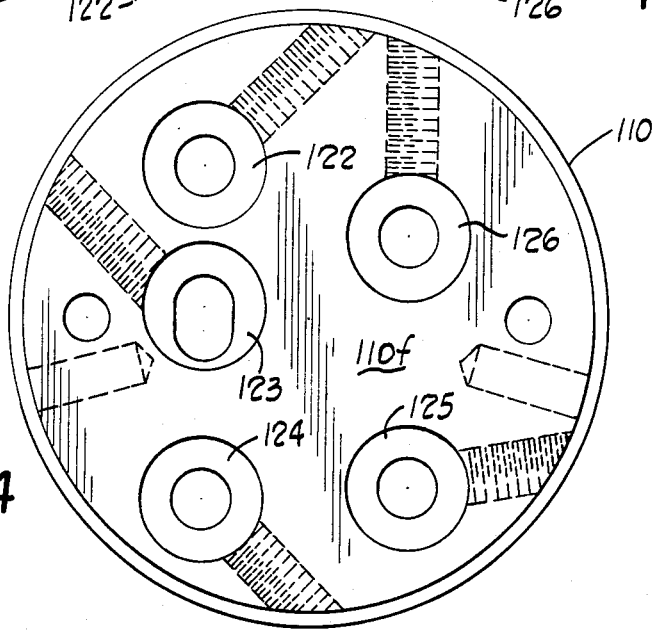
FIG. 4 is a rear elevation view of the FIG. 2 cathode cup.

An alternate cathode focusing cup 110 is illustrated in FIGS. 2–4. This cathode cup includes two transverse cavities 112, 114. A first cavity 112 is a two step cavity in which is mounted a single filament 118 and a second cavity 114 is a three step cavity having two filaments 116, 120. Energization inputs to these filaments are routed from a reverse surface 110*f* of the cathode cup through five thru-passages 122–126 extending from the back of the cathode cup to the position at which the filaments are affixed inside the two cavities 112, 114.

The three filaments 116, 118, 120 are all of different length so that energization of any one of the filaments produces a distinct and unique size focal spot on the anode 22. To produce different size and shape focal spots, the filaments are controllably actuated or energized to produce three different size focus spots. This is accomplished with three low voltage inputs 122L, 122C, 122S to the X-ray tube housing 10. These inputs come from isolation transformers located outside the tube housing 10, and may be referenced by as much as −75,000 volts D.C. with respect to the tube housing.

Figure 5:
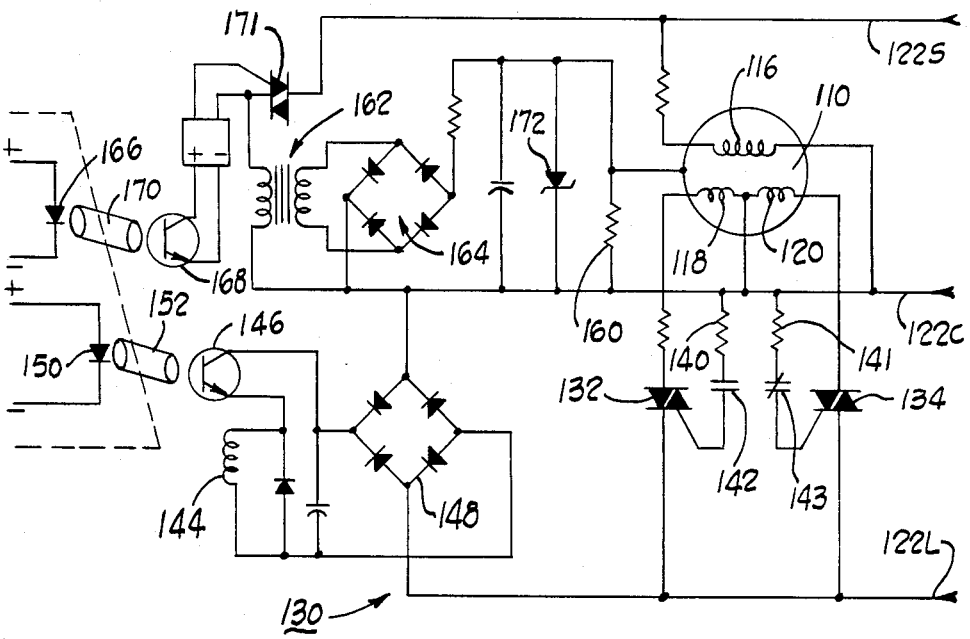
FIG. 5 is a schematic showing an energization circuit for the filaments mounted to the cathode cup shown in FIGS. 2–4.

A circuit 130 for controlling energization of the three filaments 116, 118, 120 is illustrated schematically in FIG. 5. Since the circuit 130 includes only three high voltage inputs 122S, 122C, 122L, the construction of the connector or coupling 18 need not be altered even though the cathode has three rather than the conventional two filaments. To energize the filament 116, the two inputs 122S and 122C are energized and the filament 116 will thermionically emit electrons. The common input 122C carries a D.C. signal of up to about −75,000 volts.

When the two inputs 122L and 122C are energized, one of the two filaments 118, 120 will be energized depending upon which of two triacs 132, 134 is rendered conductive. It is seen that the gate inputs to these two triacs are coupled to the input 122C through resistors 140, 141 and two relay contacts 142, 143. One contact 143 is normally closed so that, unless a relay coil 144 is energized, the triac 134 is conductive and the filament 120 is energized by the two inputs 122C and 122L to thermionically emit electrons.

The relay coil 144 is connected in series with a photo transistor 146. The coil 144 and transistor 146 are connected across a rectifying circuit 148 which produces a D.C. output from the alternating current across inputs 122C, 122L. Thus, whenever the photo transistor 146 is rendered conductive the D.C. voltage from the rectifying circuit 148 is applied to the coil 144 energizing the coil and closing the normally open contact 142 and opening the normally closed contact 143. This change of state of the two contacts applies an energization signal to the gate of the triac 132 thereby applying the A.C. energization signal from the two inputs 122C, 122L across the third filament 118.

The photo transistor 146 is optically coupled to a light emitting diode 150 outside the tube housing 10 by a fiber optic transmission path 152. Since the light emitting diode 150 is located outside the tube housing, it need not be maintained at the high electrical potential of the tube cathode. The transmission path 152 is an electric insulator so there is no danger of arcing between the low voltage of the diode 150 and the photo transistor 146.

In summary, each of the three filaments 116, 118, 120 can be individually actuated using the standard three pins 19 of the connector 18. If inputs 122S, 122C are energized, the filament 116 is activated and depending upon the state of the light emitting diode 150, either of the two filaments 118, 120 can be energized in response to an energization signal appearing at the two inputs 122C, 122L. It should be apparent that by adding an additional fiber optic transmission path the energizing affect of the inputs 122S, 122C could also be selectively applied to one of two filaments so that a four rather than a three focal spot X-ray tube is achieved.

Selectively negatively biasing the cathode cups 40, 110 with a relatively small direct current potential on the order of 150 volts also results in a four spot capability. Circuitry for this option is also shown in FIG. 5. It is seen that the cathode cup 110 is connected to the input 122C through a resistor 160. The circuit operation logic and noise suppression components of FIG. 17 and 18 are omitted from FIG. 5 for ease in illustration but may be added for operation confirmation and to improve the noise immunity of the FIG. 5 circuit.

In combination a transformer 162 and rectifying circuit 164 bias the cathode cup 110 even more negatively to reduce the width of the focal spot produced by the filament 116. An optical signal from a light emitting diode 166 outside the tube housing 10 is coupled to photo transistor 168 by a fiber optic cable 170. Again, the fiber optic cable provides high voltage isolation. When the photo transistor 168 conducts, a triac 171 turns on.

When the triac 171 conducts, the small alternating potential between inputs 122C and 122S is applied to a primary of the transformer 162 whose secondary potential is rectified, filtered and then clamped by a zener diode 172. This D.C. bias (about 150 volts) reduces the width of the focal spot from the filament 116. When the light emitting diode 166 is unenergized, the filament 116 operates conventionally.

Figure 10:
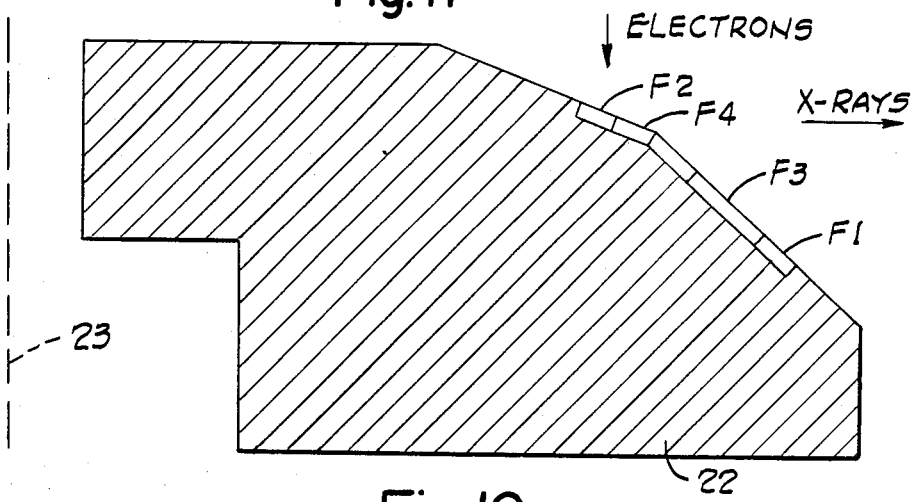
Figure 12:
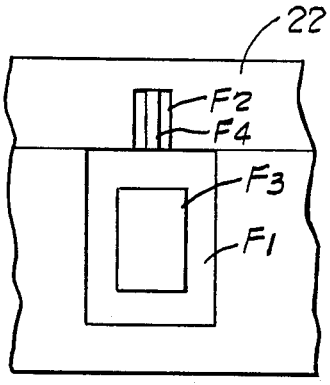

Four focal spots F1–F4 corresponding to electrons from the three filaments 116, 118, 120 are schematically illustrated in FIGS. 10 and 12 as they appear on a double angle anode 22. The 1.0 mm spot F1 corresponds to the filament 118, the 0.3 mm spot F2 to the filament 116, the 0.6 mm spot F3 to the filament 120, and the spot F4 to the filament 116 with the cathode cup 110 negatively biased. FIG. 12 schematically shows the four spots F1–F4 as seen from the window 30.

A third embodiment of the invention includes two cathode filaments 240, 241 (FIG. 6) which are selectably energizable to produce different length focus spots F5-F8 (FIGS. 11 and 13) on the tube anode 22. The filaments 240, 241 are mounted to a cathode cup 242 which is selectably energizable to focus the electrons emitted by one or the other of the filaments 240, 241.

The cathode cup 242 defines a generally flat surface 242*f* to facilitate mounting the cathode cup inside the tube. Through passages 244, 245, 246, and 247 extend from this flat surface 242*f* to the two filaments 240, 241. Electrical energization signals are routed through these passages to the filaments 240, 241.

The filaments are mounted in two stepped cavities 250, 252 in the cathode cup 242. The two filaments 240, 241 are of different length to produce different size focal spots on the anode and accordingly the two step cavities 250, 252 are also of different lengths to accommodate the different length filaments. A first of the stepped cavities 250 supports a shorter of the two filaments 240. The cavity 250 is divided into three portions 250*a*, 250*b*, 250*c*. The filament 240 extends along the innermost narrow cavity 250*c* which, in a preferred embodiment of the invention, has a width of approximately 0.047 inches.

The second of the two cavities 252 has only two steps 252*a*, 252*b* with the longer of the two filaments 241 supported inside the innermost slot 252*b*. The width of this slot in a preferred embodiment is 0.079 inches.

The cathode cup 242 is electrically biased by a circuit 254 (FIG. 9) to control the electron flow from either of the two filaments 240, 241. Energization of the cup by this circuit 254 causes an electric field to be created in the two cavities 250, 252 to focus the anode spot in a particular fashion.

The cathode cup 242 is divided into three segments 242*a*, 242*b*, 242*c* of high purity nickel. These segments are electrically isolated from each other so that in one energization state, the segments 242*a*, 242*c* are maintained at the same potential while the inner segment 242*b* is maintained at a different potential.

Figure 6:
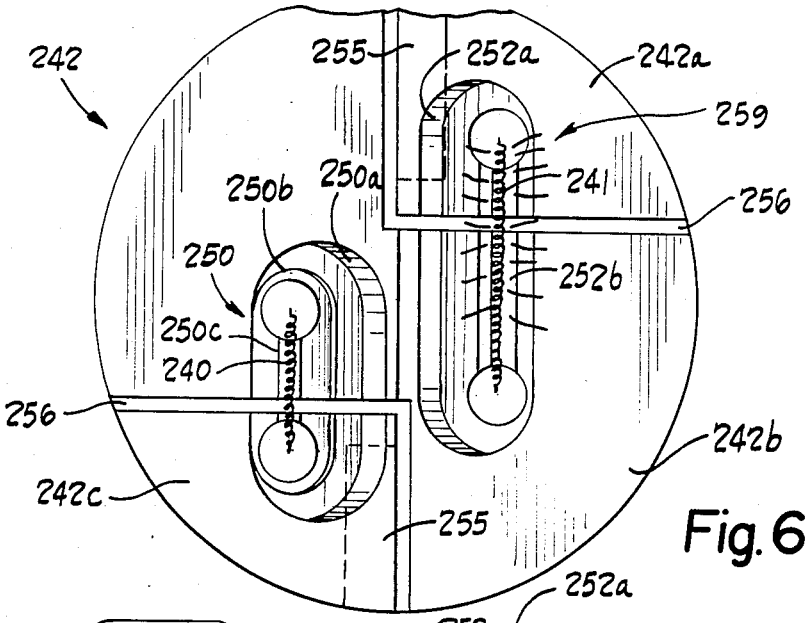
FIG. 6 is an elevation view of a segmented cathode biasing cup which supports two cathode filaments in the X-ray tube.
Figure 7:
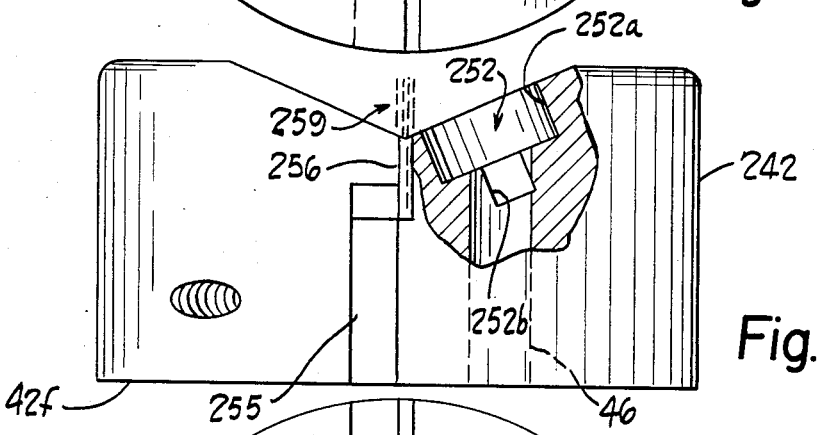
FIG. 7 is a partially sectioned elevation view of the FIG. 6 cup.
Figure 8:
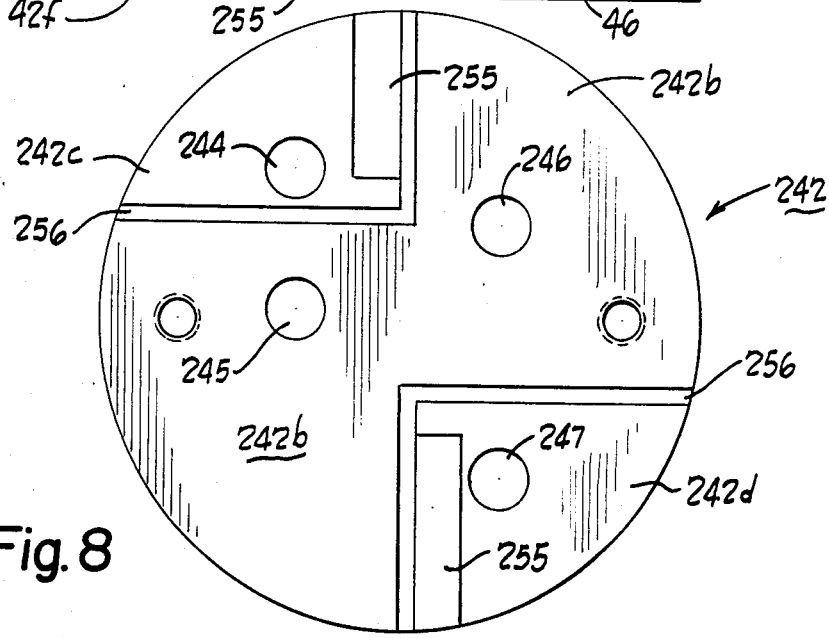
FIG. 8 is a rear elevation view of the FIG. 6 cathode cup.

The segments are electrically isolated by brazing alumina insulating blocks 255 between the segments 242*a*, 242*b*, 242*c* of the cathode cup. These blocks 255 are brazed to the segments with copper alloy. The brazed faces of the insulating blocks are metallized with molybdenum-manganese. As seen in FIG. 6 the segments 242*a*, 242*b*, 242*c* are physically separated by slots 256 extending down into the body of the cup. These slots electrically isolate the segments and avoid shorting of these segments from evaporant 259 from the incandescent filaments or other sources. The indirect path of the slots 256 through the cup to the insulating blocks 255 avoids buildup of evaporant on the blocks which could short circuit the cup segments.

One or the other of the two filaments 240, 241 are energized by low voltage transformers which are located outside of the tube housing 10. These filament inputs, which are connected to a high negative potential (with respect to housing) source and routed to the filaments through a high voltage connector 18. Three conductors 257L, 257C, 257S feed through the passageways 244, 245, 246, 247 to the filaments 240, 241. To energize one or the other of the filaments an alternating current input is introduced across the filament and electrons are thermionically emitted from the filament and accelerate to the anode 22.

Figure 9:
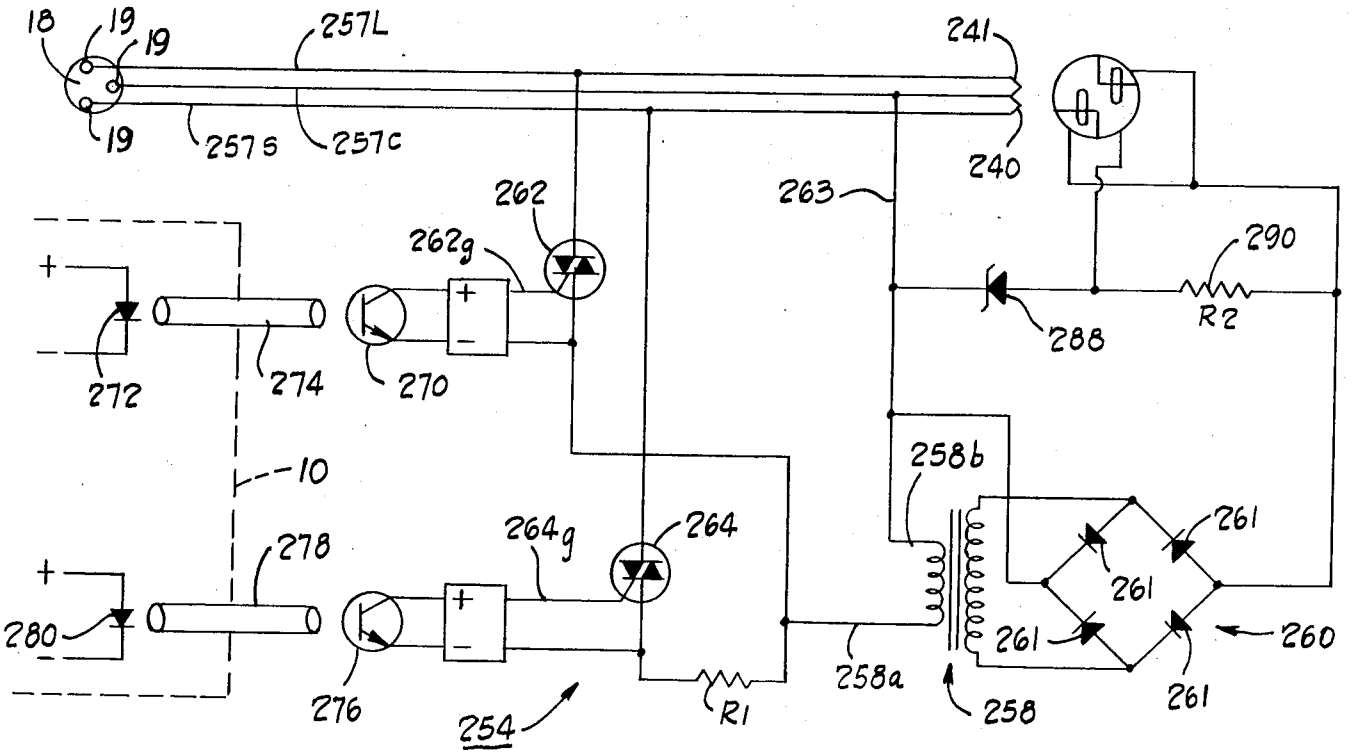
FIG. 9 is a schematic showing an electrical energization circuit for the segments of the FIG. 6 cup as well as the two filaments mounted in that cup.

The segments 242*a*, 242*b*, 242*c* of the cathode cup 242 are selectively biased by the circuit 254 illustrated in FIG. 9. A transformer 258 and a rectifying circuit 260 including four diodes 261 which rectify an A.C. output from the transformer are coupled to the conductors 257L, 257C, 257S. One input 258*a* of the transformer primary is coupled to the input 257L to the long filament 241 by a first triac 262 and to the input 257S to the shorter filament 240 by a second triac 264. A conductor 263 couples a second transformer input 258*b* to the common conductor 257C leading to the filaments 240, 241.

When neither triacs 262, 264 is conductive, no energy is tapped from the inputs to energize the segments so the three segments of the cathode cup 42*a*, 42*b*, 42*c* all float at the same potential, typically at up to 75,000 volts D.C.

To electrically separate the two outermost segments 242*a*, 242*c* from the inner segment 242*b*, one or the other of these triacs 262, 264 must be rendered conductive so that the transformer 258 can be energized by A.C. signals from one of the filament inputs. Assume that the long filament 241 is energized by the application of an alternating current signal from the filament transformer outside the X-ray tube housing. This A.C. signal will be impressed across the transformer primary if, and only if, the triac 262 is rendered conductive to complete the connection to that primary.

The triac 262 is rendered conductive by a photo transistor 270 coupled to a gate input 262*g* of the triac 262. When the photo transistor 270 is rendered conductive, current flows through this gate input 262*g* allowing energization signals from the input 257L to be transmitted through the triac 262. The photo transistor 270 is mounted inside the X-ray tube housing 10. A light emitting diode 272 communicates with the transistor 270 via a fiber optic transmission path 274. The light emitting diode 272 is located outside the tube housing 10 and need not be maintained at the extremely high electrical potentials of the X-ray tube cathode. The optical transmission path 274 is an electrical insulator so there is no danger of arcing between the low voltage of the light emitting diode 272 and the high voltage of the photo transistor 270.

In an identical manner, the triac 264 is selectively rendered conductive via a second photo transistor 276 which energizes the triac gate 264*g*. This photo transistor 276 has its own transmission path 278 and energizing light emitting diode 280 electrically isolated from the second photo transistor 276 outside the tube housing 10. It should be appreciated that when the second triac 264 is rendered conductive, the alternating signal from the input 257S is coupled to the transformer primary.

By selectively energizing one or the other of the two diodes 272, 280, in coordination with the energization of an appropriate one of the two filaments 240, 241, some of the energy from the filament energization signals is tapped off the filaments and transmitted to the transformer 258.

The fiber optic paths 274, 278 as well as the paths 152, 170 utilized in the earlier embodiment may be routed from outside the housing through access openings for other low voltage electrical signals. These signals, for example, are used to energize an anode motor for rotation of the anode.

The transformer 258 is a step-up transformer to increase the low level alternating current signal across the filaments 240, 241 to a higher level signal which is then rectified by the rectifying circuit 260. A positive output from this rectifying circuit is coupled to the common input 257C to the filaments 240, 241. The negative output from the rectifying circuit is directly coupled to the two outer cup segments 242*a*, 242*c*. The voltage on these two outer segments creates an electric field that pinches down the length of the focus spot produced by the filaments 240, 241.

A less negative potential is applied to the inner segment 242*b* of the cathode cup. In a preferred embodiment of the invention, this less negative potential is produced by a voltage divider including a zener diode 288 and a biasing resistor 290 which are coupled across the positive and negative outputs from the rectifying circuit. The voltage on this inner section 242*b* controls or pinches down the width of the focal spot so that when the segments 242*a*, 242*b*, 242*c* are energized by the rectifying circuit, the resultant focal spot on the anode 22 is both shorter and narrower than the corresponding focal spot produced by a given filament 240, 241 if no cathode segment biasing is applied.

Use of the split cathode cup has shown that less voltage should be applied to the transformer 258 when the shorter filament 240 is energized. A resistor R1 is accordingly placed in series with the transformer primary to reduce the voltage separation between the outer segments 242*a*, 242*c*.

In summary, the cathode 24 functions as a normal dual focus X-ray cathode unless and until one or the other of the light emitting diodes 272, 280 is activated to produce a biasing on the cathode cup. When this biasing is desired, the negative biased potentials are applied to the cup elements 242*a*, 242*b*, 242*c* in such a manner as to reduce the effective size of the focal spot. Since either filament sees the effect of these bias potentials, the dual filament X-ray tube operates as a four spot X-ray tube.

Figure 11:
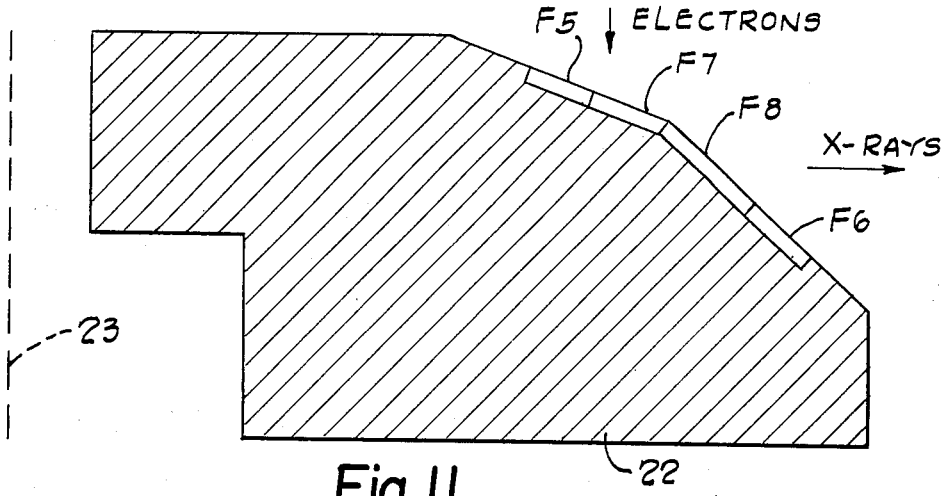
FIGS. 10 and 11 are partial sectional views of rotating anodes showing the location of focusing spots for different cathode cup and filament energization combinations.
Figure 13:
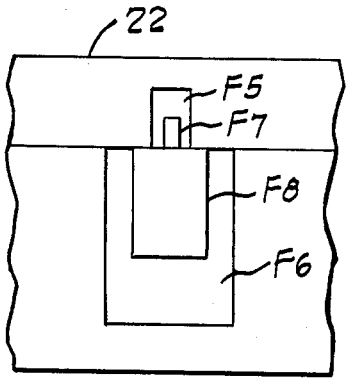
FIGS. 12 and 13 schematically show the electron pattern generated by various energizations of the X-ray tube.

This is seen by reference to FIGS. 11 and 13 where the focal spots on the anode 22 are schematically disclosed. In FIG. 11, four distinct focal spots F5–F8 are illustrated on an enlarged sectional view of a double angle anode 22. The position of the anode 22 with respect to the cathode 24 causes spots F5 and F6 from the two filaments 40, 41 to meet at approximately a double angle parting line of the anode 22. The spot F5 corresponds to energization of the shorter filament 240 and the spot F6 corresponds to energization of the longer filament 241. When the cup segments 242*a*, 242*c* are biased differently from the center segment 242*b*, the length and width of the spots are pinched down to produce the spots F7 and F8. Thus, by selective choice of filament energization signals and cup biasing signals, these four spots are producible using two filaments and no additional high voltage inputs to the X-ray tube connector 18.

FIG. 13 is a schematic showing the four focal spots F5–F8 as seen from the window 30, showing the length and width of the X-ray beam those spots produce for use in diagnosis of a patient's condition. From the view of the window, the spot F5 is 0.3 mm long, the spot F6 is 1.0 mm long, the spot F7 is 0.15 mm long and the spot F8 is 0.6 mm long. The uses for these various size focal spots is outlined in the background of the invention.

All embodiments of the present invention provide increased flexibility to the X-ray generating capabilities without a change in design for the high voltage connector 18 coupled to the tube housing. As even greater flexibility is required, the method and apparatus of the invention can be extended to provide more focal spot control. The first embodiment (FIGS. 16–18) is presently the preferred embodiment since the cathode focusing cup 40 in that embodiment is not segmented.

While various embodiments of the invention have been described with particularity, modifications to those embodiments are possible and it is the intent that all such modifications and/or alterations falling within the spirit or scope of the invention as defined by the appended claims be protected.

We claim:

1. X-ray producing apparatus comprising: an X-ray tube including (i) a tube cathode having at least one cathode filament which is energized to thermionically emit electrons;

(ii) a tube anode which is a target for electrons thermionically emitted from said cathode;

a housing for mounting said X-ray tube, said housing having a window portion to transmit X-rays generated by said tube;

means for coupling said cathode and anode to a source including a high voltage source outside said housing, said source for maintaining said cathode and anode at different electric potentials so that electrons from said filament accelerate to a focal spot on said anode;

high voltage focus control means comprising a light sensitive switch mounted inside said housing for adjusting the size and shape of said focal spot; and transmission means interposed between said high voltage source and said focus control means including a light pipe defining an optical path for directing open loop control signals to said focus control means from a controller outside said housing.

2. The apparatus of claim 1 additionally comprising monitoring means mounted inside the housing to monitor a filament energization status, said monitoring means communicating with a sensor outside the housing along an insulating communications path.

3. The apparatus of claim 2 where said monitoring means includes a light emitting diode that conducts in response to a certain filament energization status, and where the transmission means and communications path comprise separate fiber optic light paths routed through an X-ray tube housing.

4. The apparatus of claim 3 additionally comprising means located outside the X-ray tube housing for deactivating the X-ray tube in response to a malfunction in the focus control means.

5. The apparatus of claim 1 where the cathode includes three separately energizeable filaments mounted to a cathode focusing cup, said cup having three surfaces facing the anode at angles so that a filament mounted within a slot in each of the three surfaces directs electrons to a specified target are defined by anode location.

6. The apparatus of claim 5 where the anode target area for the three filaments overlaps with respect to location of the anode.

7. In an X-ray tube having a cathode and an anode and at least three separate individually energizable cathode filaments apparatus comprising:

means for routing alternating current energization signals to respective selected ones of said cathode filaments to thermionically stimulate electron emissions to propagate electrons toward the anode to define a focal spot thereon;

focus control means including bias means and connected to said means for routing to energize a particular combination of cathode filaments to adjust the focus size and shape of said focal spot on a tube anode while maintaining said adjusted focal spot generally superposed over a region with respect to said anode notwithstanding said adjustment; and transmission means for transmitting focus control signals to said focus control means.

8. The apparatus of claim 7 wherein the focus control means comprises a solid state, light responsive switch for switching among filament energization combinations and said transmission means comprises a fiber optic path coupling a light signal to said switch.

9. The apparatus of claim 8 wherein said means for routing comprises no more than three conductors for energizing three or more filaments and the control means comprises circuitry for coupling energization signals from two of said three conductors across one of said three or more filaments.

10. X-ray producing apparatus comprising: an X-ray tube including (i) a tube cathode having three separate cathode filaments which are individually energizable to thermionically emit electrons to an anode; and (ii) a tube anode having an anode surface as a target for said thermionically emitted electrons;

a housing for mounting said X-ray tube, said housing having a window portion to transmit X-rays generated by said tube;

three cathode energization inputs coupleable to an energization source with one of said inputs connected to all three cathode filaments and the other remaining two inputs coupled to at least one of the three filaments;

circuitry inside said housing for controlling energization of said cathode by selectively coupling energization signals at said inputs across a selected one of said three filaments, said circuitry including a solid state switch which changes state in response to a light signal; and fiber optic transmission means for coupling a light source outside said housing to said solid state switch.

11. X-ray producing apparatus comprising:

an X-ray tube including a tube cathode having at least one cathode filament which is energized to thermionically emit electrons and a tube anode which is a target for electrons thermionically emitted from said cathode;

a housing for mounting said X-ray tube, said housing having a window portion to transmit X-rays generated by said tube;

means for coupling said cathode and anode to a source outside said housing, said source for maintaining said cathode and anode at different electric potentials so that electrons from said filament accelerate to a focal spot on said anode;

high voltage focus control circuitry having a photo transistor switch mounted inside said housing for adjusting the size and shape of said focal spot; and a light pipe for routing visible open loop control signals to said focus control circuitry from a controller outside said housing to turn on and off said switch.

12. The apparatus of claim 11 wherein said cathode comprises a multiple segment cathode cup located for modifying electron flow from said at least one filament and said focus control circuit comprises means for electrically energizing segments of said cup to different electric potentials by tapping a bias voltage from an energization input to said filament.

13. An X-ray tube comprising:

an anode defining a target for intercepting a bean of electrons such that collisions between said electrons and the anode generate x-radiation from an anode focal spot;

a cathode for producing said flow of electrons, said cathode including one or more individually energizable filaments which emit electrons and a segmented focusing cup having two or more separated electrically energizable focus control segments;

a tube housing enclosing said cathode and said anode in a portion so that said flow of electrons strikes said anode; and means for selectively energizing said one or more filaments; and means for biasing the segments of said focusing cup to adjust the flow of electrons to said anode for adjusting the size of the focal spot to different non-zero values, and for adjusting the shape of said focal spot; said means for biasing mounted inside said housing and coupled to said means for energizing to tap energy from said means for energizing without the addition of a separate energy source.

14. In an x-ray tube having multiple, individually energizable cathode filaments mounted to an electrically biased cathode focusing cup, apparatus comprising:

means for routing alternating current energization signals to said cathode filaments to thermionically stimulate electron emission;

first focus control means connected to said means for routing to energize said cathode filaments in a preselected one of a set of combinations of said filaments to produce a desired focus size and shape on a tube anode; and second focus control means for adjusting the bias on said cathode focusing cup for adjusting the size of the focus size among various non-zero sizes;

transmission means for transmitting focus control signals to said first and second focus control means while isolating said first and second control means from ground potential.

15. The apparatus of claim 14 wherein each focus control means comprises a solid state, light responsive switch, a first switch for switching among filament energization combinations and a second switch for controllably biasing said cathode cup, and said transmission means comprises first and second fiber optic paths coupling a light signal to each said switch.

16. The apparatus of claim 15 wherein said means for routing comprises three conductors for energizing three filaments and the control means comprises circuitry for coupling energization signals from two of said three conductors across one of said three filaments.

17. An X-ray tube comprising:

an anode defining a target for intercepting a beam of electrons such that collisions between said electrons and the anode generate x-radiation from an anode focal spot;

a cathode for producing said flow of electrons, said cathode including one or more individually energizable filaments which emit electrons and a segmented focusing cup having two or more separated electrically energizable focus control segments;

a tube housing enclosing said cathode and said anode on a position so that said flow of electrons strikes said anode;

means for selectively energizing said one or more filaments; and means for biasing the segments of said focusing cup to adjust the flow of electrons to said anode among different non-zero values thereby controlling the size and shape of the focal spot; said means for biasing mounted inside said housing and coupled to said means for energizing.

18. The tube of claim 17 wherein said focusing cup comprises three conductive segments separated by a said insulating material where two outer segments can be energized to the same potential and a third segment disposed between said two outer segments is energized to a different potential.

19. The tube of claim 18 wherein said means for energizing comprises low voltage alternating potential at a high negative D.C. potential for energizing the filaments, and said means for biasing comprises means for rectifying the filament energization inputs and coupling said rectified inputs to said cup segments, and further comprising switch means for selectively coupling said means for rectifying to said filaments, and means, isolated from said high negative D.C. potential, for activating said switch means.

20. An X-ray tube comprising an anode having a rotating surface defining at least two focal spot regions and a cathode having two or more filaments which are connected to a high negative D.C. potential to direct electrons to said focal spots, said cathode further including a segmented focusing cup for controllably changing the shape of said focal spots, and circuitry for energizing said two or more filaments as well as for selectively energizing the focusing cup, said bias control circuitry including a switch electrically isolated by light pipe optical coupling at or near the high magnitude electrical potential of said filament for selectively changing the bias on said focusing cup.

21. The X-ray tube of claim 20 wherein said switch comprises a photo transistor optically coupled to a selectively energizable photodiode, said photodiode electrically isolated from said cathode by a fiber optic coupling.

22. The X-ray tube of claim 20 wherein said focusing cup is divided into three segments and said circuitry includes means for energizing a first and second of said segments to a first potential and for maintaining a third intermediate segment at a different potential.

23. In an X-ray tube of the rotating anode type, apparatus for focusing electrons from a tube cathode to focal spots on said anode comprising:

first and second individually energizeable filaments coupled to an isolation transformer which supplies an alternating current signal to said filaments;

a three segment cathode focusing cup having slots in which said first and second filaments are mounted, said cup having a middle section electrically isolated by solid insulating material from two outside segments;

a step-up transformer having a set of input and a set of output windings, for stepping up the alternating current signal across the filaments;

first and second switch means to selectively couple the alternating current signal across one or the other of said filaments to the input windings of said transformer wherein said switch means comprises photo transistors and fiber optic light pipe coupling for energizing said photo transistors;

a rectifier to full wave rectify a stepped up voltage from the output windings of said transformer; and means for coupling a D.C. bias from the rectifier to said segments to maintain the middle segment at a different potential than the outside segments and thereby focus electrons emitted by an energized filament.

24. An X-ray tube comprising:

an anode defining a target for intercepting a beam of electrons such that collisions between said electrons and the anode generate x-radiation from an anode focal spot;

a cathode for producing said flow of electrons, said cathode including one or more individually energizable filaments which emit electrons and a segmented focusing cup having two or more energizable focus control segments electrically separated from each other by one or more solid insulating members;

a tube housing enclosing said cathode and said anode in a position so that said flow of electrons strikes said anode;

means for selectively energizing said one or more filaments; and means for biasing the segments of said focusing cup to adjust the flow of electrons to said anode thereby adjusting among different non-zero values the size and shape of the focal spot;

said segments separated at a surface facing said incandescent filaments, anode, or other sources of conducting material by gaps which isolated said segments from each other while avoiding contamination of said insulating members by evaporated material from above causes, wherein said slots extend into said cathode cup to said insulating members but inhibit deposition of evaporated material onto said insulating members due to their indirect, nonstraightline path through said cup to said insulating members.

25. The X-ray tube of claim 24 wherein said focusing cup comprises three conductive segments separated by an insulating material where two outer segments can be energized to the same potential and a third segment disposed between said two outer segments is energized to a different potential.

26. In an X-Ray tube, a segmented cathode focusing cup comprising:

three conductive cup segments coupled together yet electrically separated from each other by insulating blocks brazed to said segments to form a monolithic structure, in combination said segments and blocks configured such that at a surface of said cup facing an incandescent filament, tube anode, or other source of conductive material, said segments are physically separated by slots extending into a body of said monolithic structure, said slots communicating with said insulating blocks to complete isolation of said segments along a non-direct path so that said insulating blocks are not susceptible to change in resistance from conductive evaporants from incandescent filaments and other sources inside said X-ray tube.

27. The focusing cup of claim 26 wherein said insulating blocks are alumina or other ceramic segments brazed to the conductive nickel or other metal cup segments.

28. An X-ray apparatus including a tube, said apparatus comprising:

(a) an anode defining a target for intercepting a beam of electrons, said anode being of a material such that collisions between said electrodes and said anode generate x-radiation from an anode focal spot;

(b) a cathode unit for producing said flow of electrons, said cathode including three separate individually energizeable filaments which, in response to energization, emit electrons, said cathode unit further comprising a segmented focusing cup having three or more electrically energizeable focus control segments, said segments being electrically separated from one another by solid insulating members, said segments being separated at a surface facing said filaments, anode, or other sources of conducting material by gaps which isolate said segments from each other while avoiding contamination of said insulating members by evaporated material, wherein gaps said extend into said cathode cup to said insulating members but inhibit deposition of evaporated material onto said insulating members due to their indirect, non-straightline path through said cup to said insulating members;

(c) a tube housing enclosing said cathode unit and said anode in a position so that aid flow of electrons strikes said anode;

(d) means for selectively energizing said filaments in a selected one of a set of combination;

(e) means for biasing the segments of said focusing cup in controllably variable amounts to adjust the flow of electrons to said anode for adjusting among different non-zero values at least one of the size and shape of the focal spot, and (f) control mcans for applying an open loop control signal to at least one of said energizing and biasing means, said control means comprising at least one light sensitive switch coupled to high voltage circuitry within said tube and a fiber optic light pipe communicating between said switch within said tube and the exterior of said tube.

* * * * *

UNITED STATES PATENT AND TRADEMARK OFFICE

CERTIFICATE OF CORRECTION

PATENT NO. : 4,685,118

DATED : August 4, 1987

INVENTOR(S) : Avery D. Furbee et al

It is certified that error appears in the above-identified patent and that said Letters Patent is hereby corrected as shown below:

Column 1, line 33, "eleotrically" should be --electrically--;
Column 12, line 33, "are" should be --area--;
Column 13, line 52, "bean" should be --beam--;
Column 14, line 48, "on" should be --in--;
Column 14, line 60, "said" should be --solid--;
Column 16, line 68, "gaps said" should be --said gaps--;
Column 17, line 9, "combination" should be --combinations--.

Signed and Sealed this

Eighth Day of December, 1987

*Attest:*

DONALD J. QUIGG

*Attesting Officer*

*Commissioner of Patents and Trademarks*